US007175535B1

(12) United States Patent
Marmentini

(10) Patent No.: US 7,175,535 B1
(45) Date of Patent: Feb. 13, 2007

(54) PORTABLE PLAYGROUND SWING SEAT

(76) Inventor: Peter A. Marmentini, 784 Via Colinas, Westlake Village, CA (US) 91362

( * ) Notice: Subject to any disclaimer, the term of this patent is extended or adjusted under 35 U.S.C. 154(b) by 72 days.

(21) Appl. No.: 11/041,818

(22) Filed: Jan. 25, 2005

(51) Int. Cl.
*A63G 9/00* (2006.01)

(52) U.S. Cl. ..... 472/118; 297/273

(58) Field of Classification Search ..... 472/118–125; 297/273, 274
See application file for complete search history.

(56) References Cited

U.S. PATENT DOCUMENTS 4,325,578 A * 4/1982 Borucki ..... 297/281
4,382,595 A * 5/1983 Tolar ..... 472/118
4,822,033 A * 4/1989 Kohus et al. ..... 472/119
5,326,327 A * 7/1994 Stephens et al. ..... 472/119
5,533,934 A * 7/1996 Miller ..... 472/118
5,562,548 A * 10/1996 Pinch et al. ..... 472/119
5,839,965 A * 11/1998 Mullins ..... 472/118
6,464,594 B1 * 10/2002 Canna et al. ..... 472/119
6,511,123 B1 * 1/2003 Sitarski et al. ..... 297/130
6,648,411 B2 * 11/2003 Julien ..... 297/274

* cited by examiner

*Primary Examiner*—Kien Nguyen
(74) *Attorney, Agent, or Firm*—Albert O. Cota

(57) ABSTRACT

A portable playground swing seat (10) is configured to interface with a playground swing and that includes an open-topped, rigid, cup shaped bucket (20) having a width compatible to a playground swing seat (22). The bucket is substantially oval in shape, having a raised back (24) with a hand hole (34) therethrough for manual portability. A removable soft fabric liner (42) interfaces the inner surface of the bucket to provide a supple and comfortable environment for a toddler when sitting within the portable swing seat. A five-point harness (50), which is adjustably affixed onto the bucket, is sized in length and contour to fit over the toddler's shoulders, chest and legs. Two rigid foldable attachment arms (54) are rotatably affixed onto the bucket for attachment to each playground swing chain. A swing seat strap (72) is firmly affixed onto the bottom of the bucket, and is sized in length to circumvent the lower portion of a playground swing seat for securing the swing seat to the swing along with the swing chain attachment arms.

17 Claims, 5 Drawing Sheets

PORTABLE PLAYGROUND SWING SEAT

TECHNICAL FIELD

The invention generally pertains to swing seats and more specifically to a portable swing seat that fits onto a recreational swing and incorporates a bucket having a raised back with a soft liner and a five-point harness.

BACKGROUND ART

Previously, many types of seats have been used to provide an effective means to allow toddlers to utilize conventional equipment normally used for adults or larger children. In the field of portable swing seats or seats that are utilized in combination with swings, there has been modest activity in the past.

The prior art listed below did not disclose patents that possess any of the novelty of the instant invention, however the following U.S. patents are considered related:

| U.S. Pat. No. | Inventor | Issue Date |
|---|---|---|
| 4,328,595 | Tolar | May 10, 1983 |
| 4,415,200 | Bourne | Nov. 15, 1983 |
| 4,976,494 | Polley | Dec. 11, 1990 |
| 5,533,934 | Miller | Jul. 9, 1996 |
| 5,427,575 | Berk | Jun. 27, 1995 |
| 5,560,679 | Barnholdt | Oct. 1, 1996 |
| 5,876,289 | Liu | Mar. 2, 1999 |
| 6,416,132 | Norton et al. | Jul. 9, 2002 |

U.S. Pat. No. 4,328,595 discloses a swing seat adapter that is positionable in an elongated horizontal transverse seat of a swing suspended at it's opposite ends. The swing seat adapter is removably connected between the upper portion of the sides and adjacent portion of the suspension members, thus preventing the seat from excessive forward or rearward tilting. Further, an occupant restraining harness is provided for releasably securing a child therein.

U.S. Pat. No. 4,415,200 discloses a combination seat and swing for an infant that is mounted at a table or attached to a chain, thereby providing a swing for the infant.

U.S. Pat. No. 4,976,494 discloses a forward recumbent posture pod for supporting the anterior torso of an infant, thus allowing substantial unrestricted movement of the infant's limbs and head. The pod includes a posterior portion and side portions to restrain backward and sideway movements away from the posture pod.

U.S. Pat. No. 5,533,934 discloses a child safety device for converting a belt seat playground swing into a child seat safety swing which includes an attachment for securement to the chains of a playground swing. The invention includes a waist strap, under straps, crotch straps and mesh netting, which are all securely stitched together to form a child receiving cavity. The child's weight bares upon the belt seat of the swing and the safety device secures the child to the belt seat.

U.S. Pat. No. 5,427,575 discloses a toteable swing kit having a variety of seats. The swing kit includes a seat and a nylon rope with a bead at the end for securing both the seat and swing, as well as for providing adjustment. The changeable seats have different designs.

U.S. Pat. No. 5,560,679 discloses a seat for supporting a child in a spaced orientation relative to a support surface. A foot rest is mounted to the seat member for supporting the feet of an individual and can be pivoted into a storage recess within the seat member for storage during periods of non-use.

U.S. Pat. No. 5,876,289 teaches a safety swing seat attached on a coupling mechanism which is mounted between a support frame and a swing seat. The coupling includes a pivot pin and a plate, thereby allowing the seat to limit the swing angle.

U.S. Pat. No. 6,416,132 discloses a swing seat described as a chair having a seat with a bar coupled on one end. The other end of the bar engages the bottom of the chair. When coupled to the chair, the bar is positioned to allow the removal of the child from the chair. Straps secure the child to the chair and ropes are coupled to the chair, thus allowing the swing seat to be suspended above the surface.

For background purposes and as indicative of the art to which the invention is related reference may be made to the remaining cited patent issued to Shannon et al. No. 4,524,966 disclosing a swing seat.

DISCLOSURE OF THE INVENTION

At a park where swings are available, the swings for infants are usually of the fully enclosed type that have a circular band around the top and leg holes to secure an infant. In actuality, the swings are designed for children who are 2 to 5 years old. It is common practice for parents to place their children in the bucket swing seats as early as six months of age, if not younger. This can be very dangerous. Children at this age have not developed sufficient upper body strength to support themselves upright. Thus, with the swinging motion, injuries can occur to a child's head, neck and/or back. Often a parent will choose not to use the "bucket" swing for their child under two years of age because of this danger, as well as other dangers, such as germs and burns. Additionally, in many parks there is not a 2 to 5 year-old bucket swing seat available. When there is only a single belt strap seat type or a solid flat seat, an adult must hold the child on his or her lap, grasp the chains of the swing, and hold the child safely at the same time. Doing this is uncomfortable as well as dangerous. When an infant becomes a toddler, which ranges in age from 6 months to 23 months, and in cases where the only swings available are the single strap seat type or a solid flat seat, a problem exists.

Therefore, the primary object of the invention is to provide a strong, durable and yet safe portable playground swing seat that is age appropriate, easily carried and that quickly attaches to a playground/home swing seat. The swing seat will give personal ownership and control of when an adult places their child while using the swing. The swing seat securely holds the toddler from falling out and protects the toddler's neck from jolts or sudden stops. The combination of a robust strapping arrangement and a raised, slightly-slanted back prevents head, neck and back injury to toddlers and small children during swinging. The invention is designed to follow all ASTM standards and guidelines for children of the age group utilizing the swing seat.

An important object of the invention is the easy installation and removal of the seat to a playground swing. A hand opening located on the back of the invention provides a straightforward and easy means of transportation of the swing set, and when placed on the seat, a pair of rigid attaching arms are snapped from their retaining clips and rotated upward to interface with the swing chains or ropes. Wrap around straps secure the attaching arms to the chains, which permits a locked attachment to any type of ropes, steel chains or plastic coated chains. When the arms are secured to a swing seat-strap, which is threaded through a hollow cavity in the base of the swing seat bucket, is attached together on the two opposed ends and circumventing the lower portion of the playground swing seat, thereby completely securing the infant swing seat to the playground swing set.

An equally important object of the invention is the use of a five-point, quick-release adjustable harness, which is rigidly attached to the swing seat bucket in an adjustable manner providing maximum protection for the toddler and permit personalized fitting to each toddler. Extending ends of the straps may be grasped and pulled snug against the child while the bucket itself is firmly tightened around the swing seat and chains. The use of the five-point quick-release adjustable harness, in conjunction with a number of slots in the back of the upright portion of the bucket, permits the invention's shoulder and chest straps to be adjusted to conform to the age of the toddler or child. From then on only attaching or releasing of the main buckle is necessary.

Another object of the invention is that the main structural swing seat bucket is made of rigid durable thermoplastic which is very stout, rugged, and robust. This type of construction not only permits the invention to be carried by hand using the convenient hand opening in the top back portion of the bucket, but the invention can also be easily stored in the interior or the trunk of a car. Further, the fact that the bucket's outer shell is opaque protects an infant from sunburn and the strength of the outer shell shields the infant or toddler from direct blows from another child's toy or hitting an object during swinging.

Still another object of the invention is that a fabric liner is utilized within the interior of the bucket. The liner is made of a soft fabric material and provides a supple and comfortable environment for a toddler when sitting within the portable swing seat. The liner is also washable, which keeps a child free from microorganisms that may cause infections or diseases. The liner is removable from the bucket for washing by simply unsnapping the snap fasteners or detaching a plurality of hook and loop tape fasteners. It should be noted that the liner also provides protection for the toddler in the event that the seat has been attached to the swing and allowed to become hot from the sun. The plastic bucket may be hot to the touch, however with the fabric liner the major portion of the seat is protected.

Yet another object of the invention is that the portable playground swing seat fits almost all conventional park swings, and home swing seats, as it has been found that the strap seat or flat seat is typically 18 inches to 22 inches in length (chain to chain) (45.7 cm) and 4 inches to 8 inches in width (front of seat to back). The pivotal attachment arms and strapping arrangement is extremely forgiving, as there are two arms that engage a swing's chains directly and encompass the chains with the wrap around strap. The seat strap is attached underneath the seat and is adjustable in length, which enables secure attachment of the rigid bucket to the swing on either a rigid seat or a resilient strap type seat.

A further object of the invention is the ability of the swing seat to be attached and secured to any flat surface and be used as a booster seat. The swing seat is particularly useful when at a park after utilizing the swing seat on the swing, to remove the swing seat and attach it to a bench seat of a picnic table, thus keeping a child safe and allowing everyone to enjoy their meal.

A final object of the invention is that an optional attachment of a sun shield or hood, similar to those used on a stroller, may be connected to the seat bucket, with the sun shield or hood fastening sockets integrally formed in the back of the bucket. The hood protects the toddler from the direct rays of the sun and may be added or removed easily.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
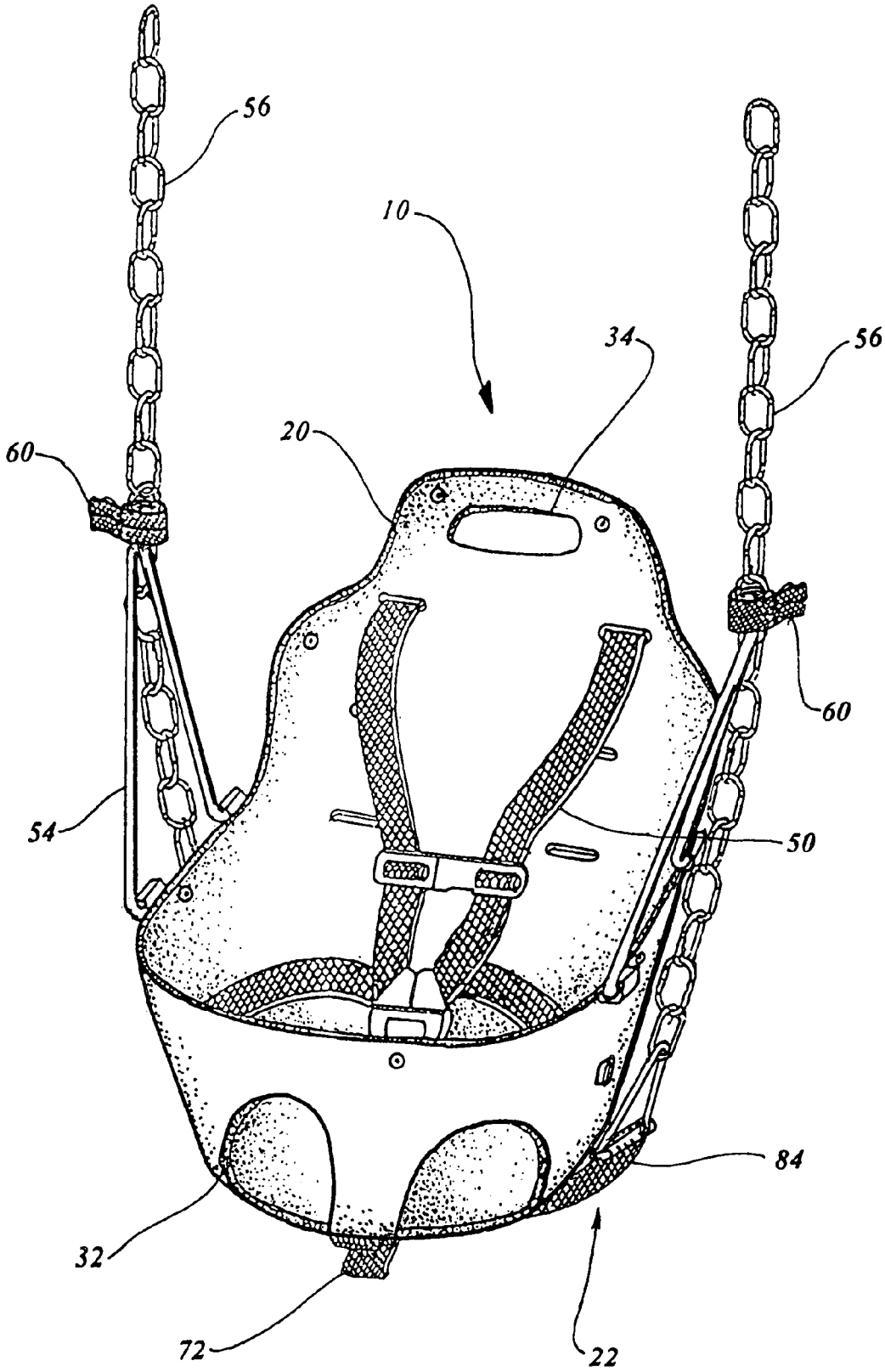
FIG. 1 is a partial isometric view of the preferred embodiment attached onto a playground swing seat.

The best mode for carrying out the invention is presented in terms of a preferred embodiment for a portable playground swing seat that is configured to interface with a playground swing designed to hold an infant or a toddler. The preferred embodiment of the portable playground swing seat 10, as shown in FIGS. 1 through 17, is comprised of an open-topped, rigid, cup shaped bucket 20 having a width compatible with a playground swing seat 22. The bucket 20 is essentially oval in shape, having a raised back 24, vertical sides 26, a front 28 and a bottom 30. The front 28 has a pair of leg openings 32 therethrougth, and the raised back 24 includes a hand hole 34, for manually transporting the swing seat 20 to an existing playground swing set 36.

The portable swing seat bucket 20 preferably includes a plurality of ribbed feet 38 that are integrally formed within the open-topped, rigid, cup shaped bucket 20, thus allowing the swing seat 10 to sit level when resting on a flat surface. The ribbed feet 38 are illustrated best in FIGS. 2, 6 and 11. Optionally, at least one sun hood fastening socket 40 is integrally formed or attached to the bucket 20, preferably in pairs, for mounting a sun hood over the top of the swing seat 10. The sun hood provides protection from the elements when a toddler is sitting in the swing seat. The preferred material and method of manufacture of the open-topped, rigid, cup shaped bucket 20 is a thermoplastic material such as polymer or the like, with a vacuum formed or injection molded construction.

Figure 9:
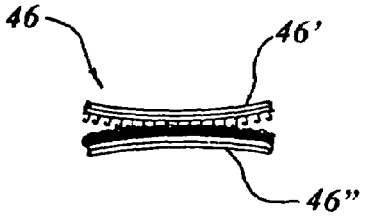
FIG. 9 is a partial side view of the optional hook and loop tape used to attach the liner to the bucket.
Figure 11:
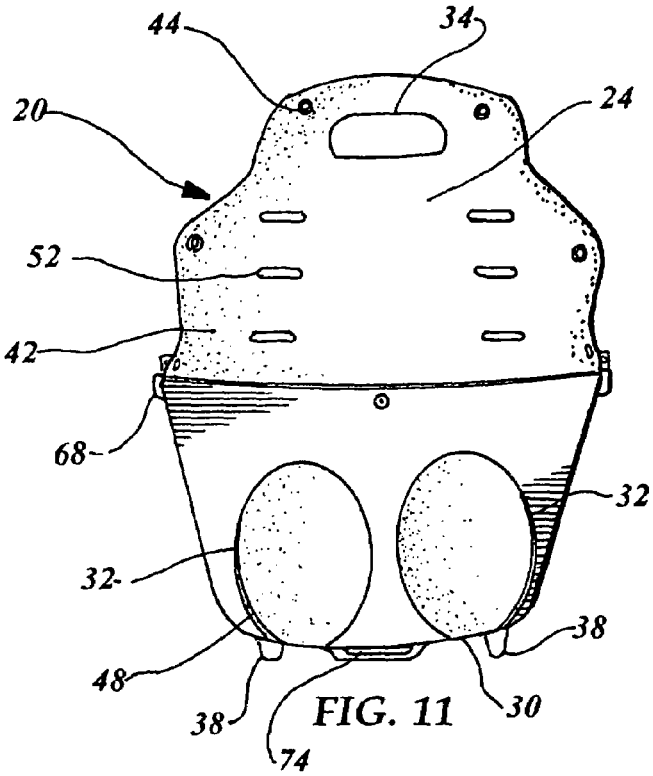
FIG. 11 is a front view of the portable swing seat with the liner in place less the attachment arms.

In order to protect and provide a supple and comfortable environment for a toddler when sitting within the portable swing seat 10, a removable soft fabric liner 42 is provided that intimately embraces the inner surface of the bucket 20. The fabric liner 42 is washable and preferably includes a plurality of snap fasteners 44 that allows the liner to be fastened and removed from the bucket 20 for laundering. Alternatively, a plurality of individual hook and loop tape fasteners 46 or the like may also be used with equal ease for this purpose. The snap fasteners 44 are illustrated alone in FIG. 8, and attached to the bucket 20 and liner 42 in FIGS. 1, 2, 6, 7, 10 and 11. The hook and loop fasteners 46 are illustrated in FIG. 9, with the hook portion 46' on the top and the loop portion 46" on the bottom.

While any material may be used for the liner 42, a woven material such as cloth of natural or synthetic fiber is preferred. Additionally, a woven material may be padded and/or quilted to provide softness. It is also beneficial to have a padded portion 48 surrounding the leg openings 32 for supplementary comfort of the infant or toddler.

Figure 2:
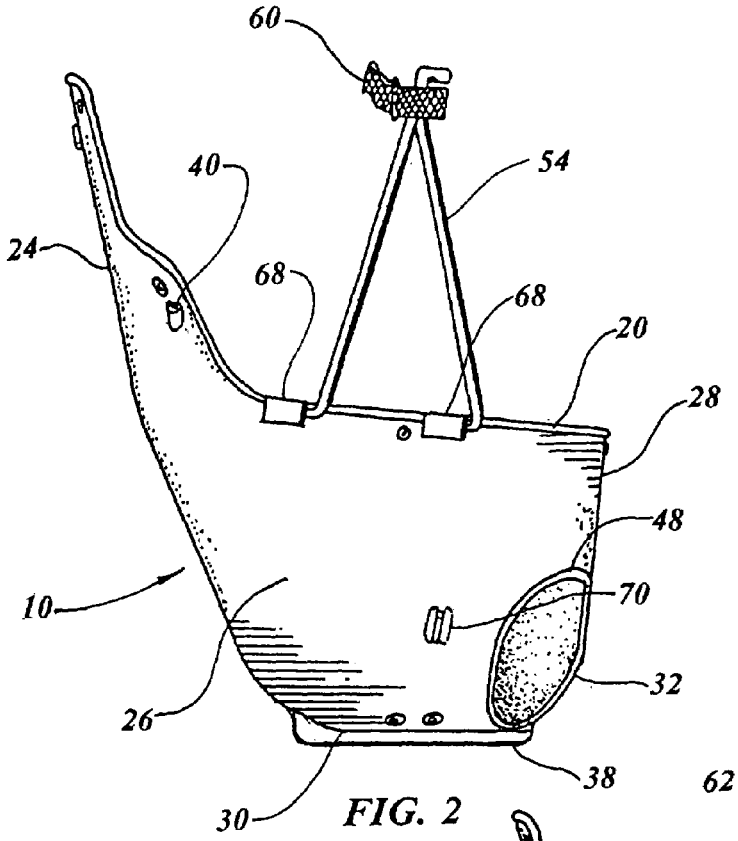
FIG. 2 is a side view of the preferred embodiment with the chain attachment arms in the extended position.
Figure 6:
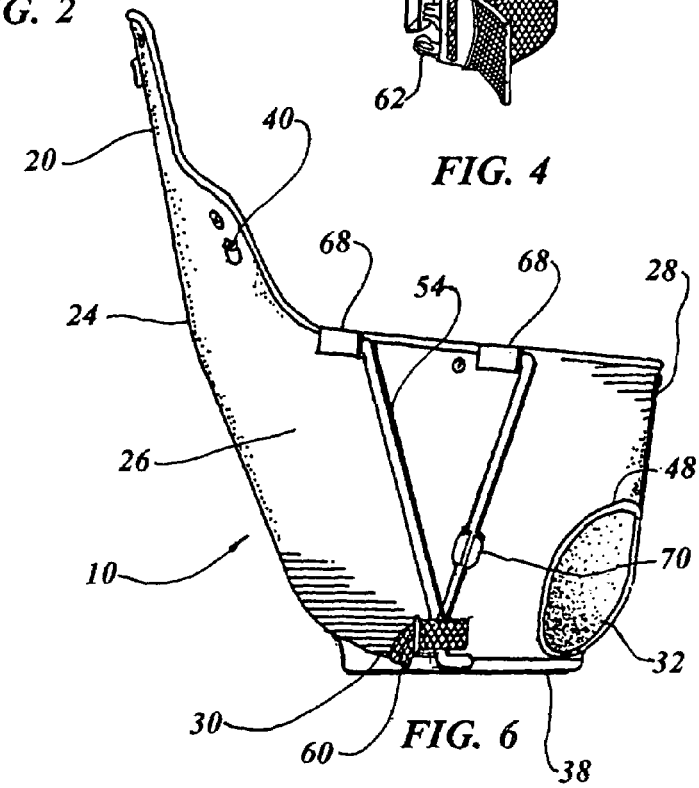
FIG. 6 is a side view of the preferred embodiment with the chain attachment arms in the retracted position.
Figure 7:
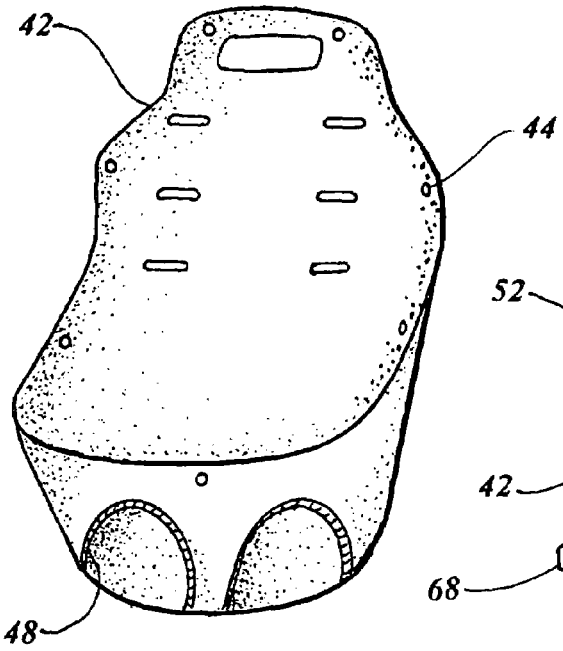
FIG. 7 is a partial isometric view of the removable fabric liner taken out of the bucket entirely.
Figure 10:
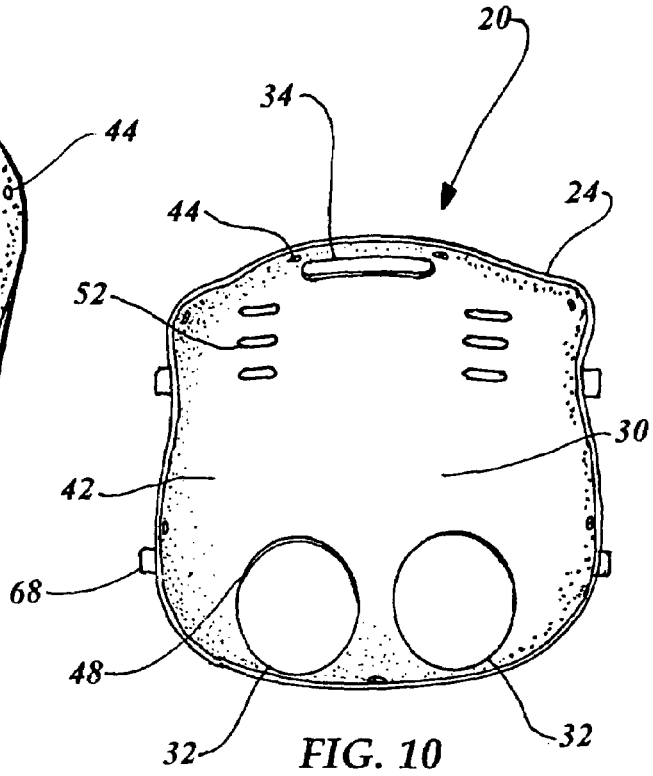
FIG. 10 is a plan view of the portable swing seat with the liner in place less the attachment arms.
Figure 8:
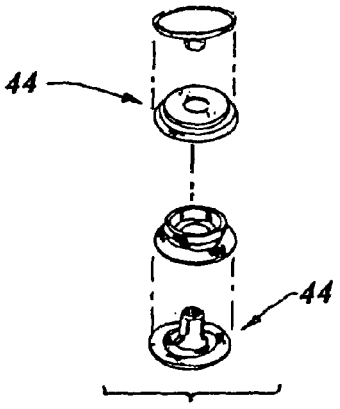
FIG. 8 is an exploded partial isometric view of the preferred snap fasteners used to attach the liner to the bucket.

A five-point, quick-release adjustable harness 50 is affixed onto the bucket 20 and is sized in length and contour to fit over the infant or toddler's shoulders, chest and legs. The connection of the harness 50 is preferably achieved using strong connections such as slots 52. The slots 52 provide openings for the five ends of the harness, with restraints utilized on the outside surface of the bucket 20, such as slide stops or simply folded over on the inside and attached with rivets, threaded fasteners or the like, as illustrated in FIGS. 2 and 6. The bucket 20 includes a plurality of slots 52 within the raised back 24, thus permitting the harness 50 to be attached through appropriate slots according to the infant or toddler's physical size and allowing the swing seat 10 to be used during the period of growth from an infant to a toddler. The actual physical construction of the five point harness 50 is well known in the art.

Figure 16:
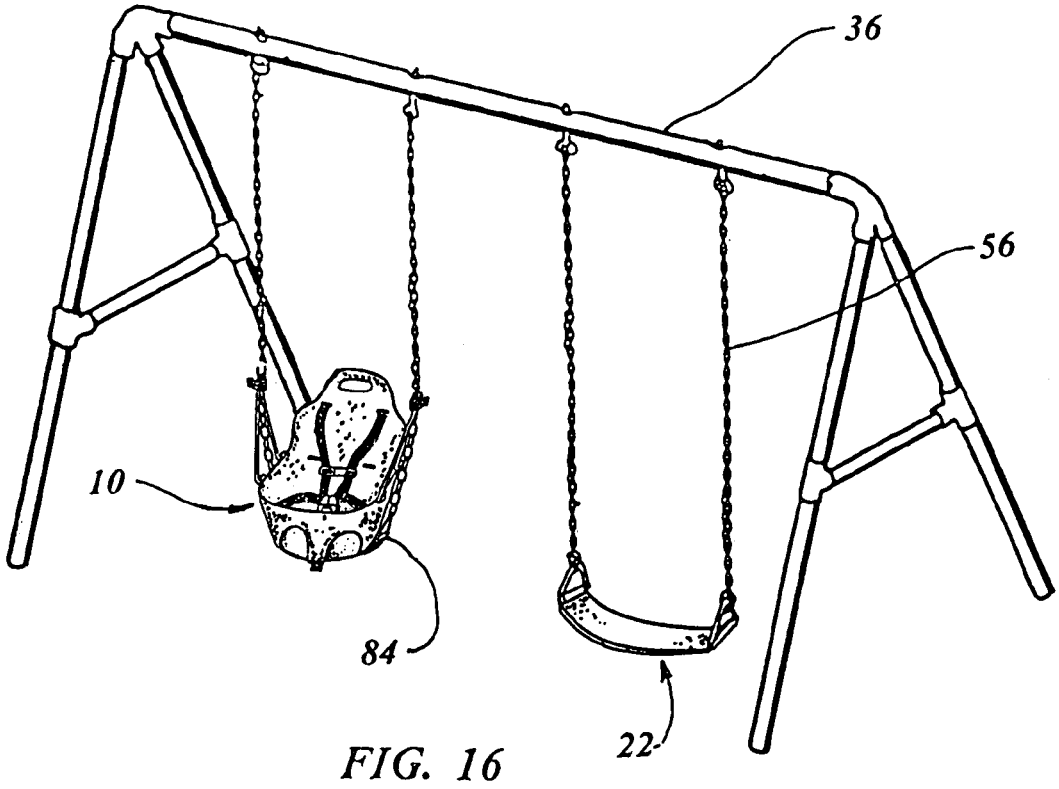
FIG. 16 is a partial isometric view of the preferred embodiment attached to a strap type seat swing attached with chains.
Figure 17:
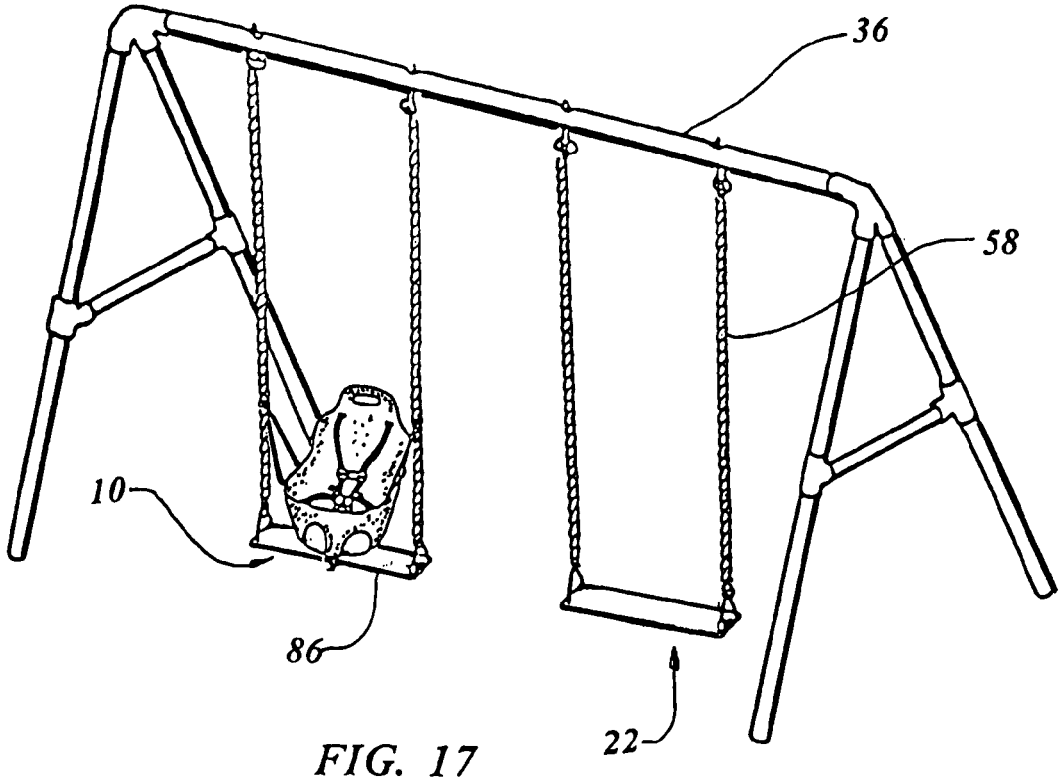
FIG. 17 is a partial isometric view of the preferred embodiment attached to a rigid type seat swing attached with ropes.

A pair of rigid, foldable, swing chain attachment arms 54 are rotatably affixed onto each side of the bucket 20 and are designed to be enclosed and attached to each playground swing chain 56, as illustrated in FIGS. 1, 16 and 17. It should be noted that while most conventional swing sets 36 are equipped with chains 56, some of the older designs or homemade swings utilize a rope 58, as shown in FIG. 17.

Figure 3:
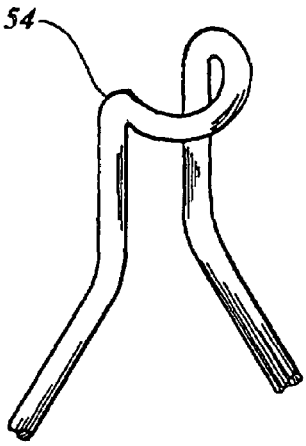
FIG. 3 is a fragmentary isometric view of the upper end of the chain attachment arms in the preferred embodiment.
Figure 4:
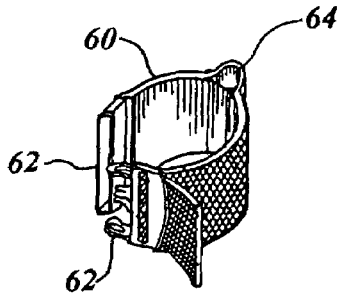
FIG. 4 is a partial isometric view of one of the wrap-around straps for securing the attachment arms to the playground swing chain.

The attachment arms 54 are preferably fabricated as a wireform structure, with a portion arcuately formed in a semi-circle for contiguously engaging at least half of each playground swing chain, as illustrated in FIG. 3. In order to secure the wireform structure to the chain 56 or rope 58, a wrap-around strap 60, depicted in FIG. 4, having a quick release closure 62, is utilized. The strap 60 is attached to each wireform structure with a loop 64, or the like, thereby allowing the strap 60 to envelop the playground swing chains 56 or ropes 58. The quick release closure 62 is well known in the art and is in present use in many applications.

Figure 5:
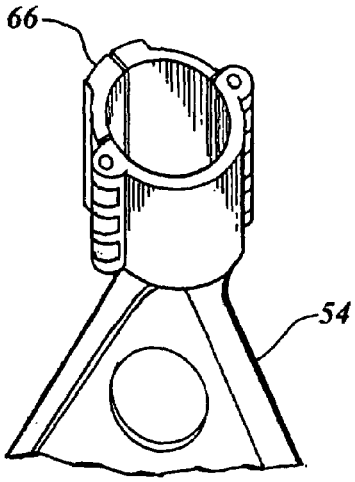
FIG. 5 is a fragmentary isometric view of a variation depicting the upper end of the chain attachment arms in the thermoplastic alternate embodiment.

An alternate embodiment of the attachment arms 54, as shown in FIG. 5, is a thermoplastic construction, which includes an integral clamp 66 for enveloping the playground swing chains 56 or ropes 58 in a removable manner. Hinges may be integrally formed in the arms 54, and a snap release using the living hinge principle may be used for the closure around the swing chains 56 or ropes 58. In either case, the attachment arms 54 are connected to the bucket 20 with integral arm attaching sockets 68 or may be fastened separately, however in either method the arms 54 are free to rotate within the sockets 68. Preferably, the arms 54 are secured within the sockets 68 with methods well known in the art, and when folded down to the sides 26 of the bucket 20, a clip 70 is either molded within the bucket 20 or attached separately to retain at least one of the attachment arms 54, as shown in FIG. 6.

A swing seat strap 72 is securely affixed onto the bottom of the bucket and is sized in length to circumvent the lower portion of the playground swing seat 22. The strap 72 is utilized for securing the infant swing seat 10 to the playground swing set 36 in concert with the swing chain attachment arms 54. The swing seat strap 72 is made of a webbing material preferably of polypropylene, nylon, polyester cotton or cotton with a nylon core. The bucket 20 includes a hollow cavity 74 that is integrally formed within its bottom 30, with the webbing of the strap 72 disposed within the cavity 74 for positive securement between the bucket 22 and the playground swing seat 22.

Figure 12:
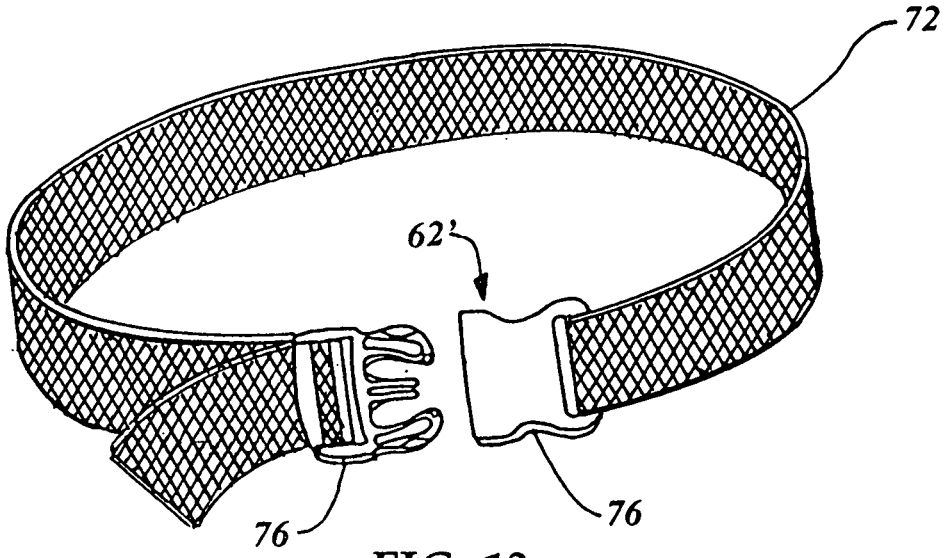
FIG. 12 is a partial isometric view of the swing seat strap with a side release buckle in the preferred embodiment, completely removed from the invention for clarity.
Figure 13:
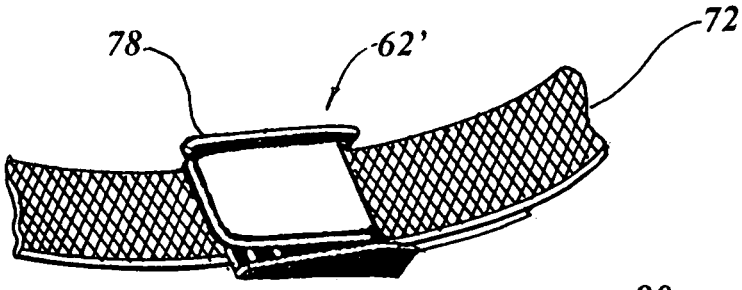
FIG. 13 is a partial isometric view of the swing seat strap with an optional cam release buckle, completely removed from the invention for clarity.
Figure 14:
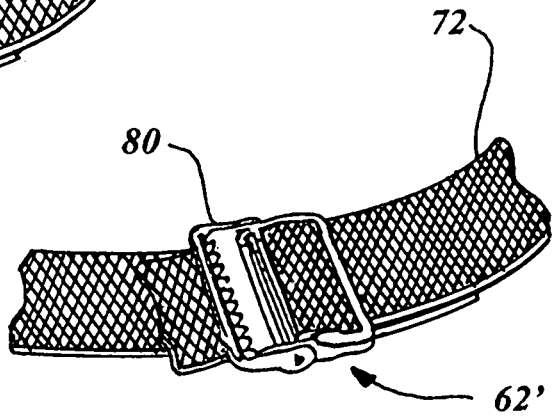
FIG. 14 is a partial isometric view of the swing seat strap with an optional lift release buckle, completely removed from the invention for clarity.
Figure 15:
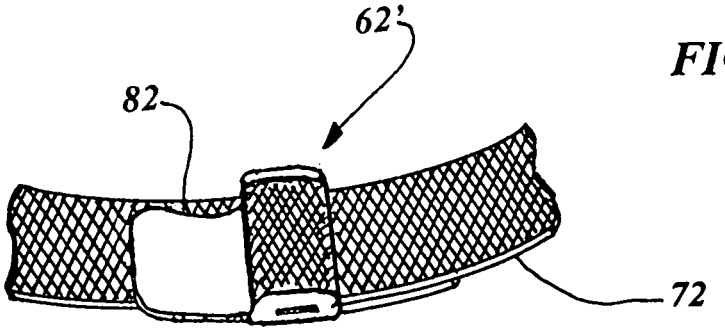
FIG. 15 is a partial isometric view of the swing seat strap with an optional slide release buckle, completely removed from the invention for clarity.

The swing seat strap 72 includes a quick release closure 62' for attaching the ends of the strap 72 together in a removable manner, such as a side release buckle 76, a cam release buckle 78, a slide release buckle 82, a lift release buckle 84, and a hook and loop fastener 46. FIG. 12 illustrates the swing seat strap closure 62' as a side release buckle 76, FIG. 13 depicts an optional cam release buckle 78, FIG. 14 an optional lift release buckle 80, and FIG. 15 an optional slide release buckle 82.

During use, the swing seat 10 is carried to the playground swing set 36 by holding the swing seat 10 via the hand hole 34, with the attachment arms 54 folded down, as shown in FIG. 6. The bucket 20 is placed on the playground swing seat 22 and rests on the bottom 30 and ribbed feet 38. There are two basic types of playground swing seats 22: the strap seat 84, as illustrated in FIGS. 1 and 16, which is now the most common type, and the flat seat 86, as shown in FIG. 17, with the invention applicable to either one. When the bucket 20 is resting sideways on the swing seat 22, the arms 54 are unsnapped from the retaining clips 70 and raised. The bucket is then rotated and aligned with the seat 22 such that the arms 54 interface with the swing chains 56 or ropes 58. The wrap around straps 60 or integral clamp 66 are attached around the swing chains 56 or ropes 58 to secure the arms 54. The swing seat strap 72 is already positioned in the hollow cavity 74 in the bucket 20, and the two ends are attached together to circumvent the lower portion of the playground swing seat 22, thereby completely securing the infant swing seat 10 to the playground swing set 36. The infant is then be placed in the bucket 20 and the five-point harness 50 is attached and adjusted properly.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A portable playground swing seat configured to interface with a playground swing comprising:

a) an open-topped, rigid, cup shaped bucket having a width compatible with a conventional swing seat, said bucket substantially oval in shape, having a raised back, vertical sides, a front and a bottom, with said front having a pair of leg openings therethrougth, said back having a hand hole therethrough for manual portability, and a plurality of ribbed feet integrally formed within the open-topped, rigid, cup shaped bucket to allow the swing seat to sit level when resting on a flat surface, b) a removable soft fabric liner intimately embracing the bucket on an inner surface to provide a supple and comfortable environment for a toddler when sitting within the portable swing seat, c) a five-point harness that is adjustable affixed onto the bucket, and is sized in length and contour to fit over an occupant's collective shoulders, chest and legs d) a pair of rigid foldable swing chain attachment arms that are rotatable affixed onto each side of the bucket and are designed to be enclosed and attached to each playground swing chain, and e) a swing seat strap that is firmly affixed onto the bottom of the bucket, and is sized in length to circumvent the lower portion of a playground swing seat for securing the portable playground swing seat to the swing in concert with the swing chain attachment arms, a plurality of ribbed feet that are integrally formed within the open-topped, rigid, cup shaped bucket to allow the swing seat to sit level when resting on a flat surface.

2. The portable playground swing seat as recited in claim 1 further comprising at least one sun hood fastening socket for mounting a sun hood over the top of the swing seat, thereby providing protection from the elements when a toddler is sitting in the swing seat.

3. The portable playground swing seat as recited in claim 1 wherein said open-topped, rigid, cup shaped bucket further comprises a vacuum formed thermoplastic construction.

4. The portable playground swing seat as recited in claim 1 wherein said soft fabric liner is washable.

5. The portable playground swing seat as recited in claim 4 wherein said washable soft fabric liner further comprises a plurality of snap fasteners that allow the liner to be fastened and removed from the bucket for laundering.

6. The portable playground swing seat as recited in claim 4 wherein said washable soft fabric liner further comprises a plurality of individual hook and loop fasteners that allow the liner to be fastened and removed from the bucket for laundering.

7. The portable playground swing seat as recited in claim 1 wherein said soft fabric liner further comprises a padded portion surrounding the leg openings.

8. The portable playground swing seat as recited in claim 1 wherein said soft fabric liner further comprises woven fabric.

9. The portable playground swing seat as recited in claim 1 wherein said soft fabric liner is quilted.

10. The portable playground swing seat as recited in claim 1 wherein said five-point harness that is adjustably affixed onto the bucket further comprises said bucket having a plurality of slots within said raised back, thus permitting the harness to be attached through an appropriate slot according to an infant or toddler's physical size.

11. The portable playground swing seat as recited in claim 1 wherein said pair of rigid foldable swing chain attachment arms further comprise a wireform structure with a portion arcuately formed in a semi-circle for contiguously engaging at least half of each playground swing chain.

12. The portable playground swing seat as recited in claim 11 wherein said wireform structure further comprises a wrap-around strap having a quick release closure, with said strap attached to each wireform structure to removably envelop the playground swing chains.

13. The portable playground swing seat as recited in claim 1 wherein said pair of rigid foldable swing chain attachment arms further comprise a thermoplastic construction.

14. The portable playground swing seat as recited in claim 13 wherein said rigid foldable swing chain attachment arms having a thermoplastic construction further comprise an integral clamp for enveloping the playground swing chains in a removable manner.

15. The portable playground swing seat as recited in claim 1 wherein said swing seat strap further comprises a webbing material selected from the group consisting of polypropylene, nylon, polyester cotton and cotton with nylon core, wherein said bucket having a hollow cavity integrally formed within the bottom of the bucket, with said webbing of the swing seat strap disposed within the cavity for positive securement between the bucket and the playground swing seat.

16. The portable playground swing seat as recited in claim 1 wherein said swing seat strap further comprising a quick-release closure for attaching the strap ends together in a removable manner.

17. The portable playground swing seat as recited in claim 16 wherein said quick-release closure is selected from the group consisting of a side release buckle, a cam release buckle, a slide release buckle, lift release buckle, and hook and loop fastener.

* * * * *